US007077717B2

(12) United States Patent
Cheng et al.

(10) Patent No.: US 7,077,717 B2
(45) Date of Patent: Jul. 18, 2006

(54) DOLL WITH ANGLED AND JOINTED TORSO

(75) Inventors: Bryan Cheng, Kowloon (HK); Kevin Harmon, Mission Viejo, CA (US)

(73) Assignee: Mattel, Inc., El Segundo, CA (US)

( * ) Notice: Subject to any disclaimer, the term of this patent is extended or adjusted under 35 U.S.C. 154(b) by 143 days.

(21) Appl. No.: 10/853,561

(22) Filed: May 24, 2004

(65) Prior Publication Data

US 2005/0112993 A1 May 26, 2005

Related U.S. Application Data

(60) Provisional application No. 60/473,908, filed on May 27, 2003.

(51) Int. Cl.
*A63H 3/46* (2006.01)

(52) U.S. Cl. ..... 446/376; 446/383

(58) Field of Classification Search ..... 446/330, 446/373, 375, 376, 383; 40/414, 417, 418–420
See application file for complete search history.

(56) References Cited

U.S. PATENT DOCUMENTS

| | | | | |
|---|---|---|---|---|
| 546,791 | A | | 9/1895 | Verpillier et al. |
| 553,643 | A | | 1/1896 | Fausel |
| 634,503 | A | | 10/1899 | Morrow |
| 703,899 | A | | 7/1902 | Debes |
| 982,096 | A | | 1/1911 | Schoenhut |
| 1,270,781 | A | | 7/1918 | Cabana |
| 1,359,030 | A | | 11/1920 | Cabana |
| 1,932,216 | A | | 2/1933 | Kallus |
| 2,129,421 | A | | 9/1938 | Hales |
| 2,215,500 | A | | 9/1940 | Greneker |
| 2,727,334 | A | | 12/1955 | Ostrander |
| 3,010,253 | A | | 11/1961 | Ostrander |
| 3,094,376 | A | | 6/1963 | Thomas |
| 3,265,257 | A | | 8/1966 | Buonamici |
| 3,277,602 | A | | 10/1966 | Speers et al. |
| 3,465,474 | A | * | 9/1969 | Gardel et al. ..... 446/351 |
| 3,557,471 | A | | 1/1971 | Payne et al. |
| 3,591,669 | A | | 7/1971 | Memory |
| 3,628,282 | A | | 12/1971 | Johnson |
| 3,648,405 | A | | 3/1972 | Tepper |
| 3,699,710 | A | | 10/1972 | Glass et al. |
| 3,701,215 | A | | 10/1972 | Marason et al. |
| 3,731,426 | A | | 5/1973 | Lewis et al. |
| 3,740,894 | A | | 6/1973 | Howland et al. |
| 3,895,451 | A | | 7/1975 | Smrcka |

(Continued)

FOREIGN PATENT DOCUMENTS

| | | |
|---|---|---|
| EP | 0250063 | 3/1987 |

(Continued)

OTHER PUBLICATIONS

1978 CPG Action Man Figure.

(Continued)

*Primary Examiner*—Kien Nguyen
(74) *Attorney, Agent, or Firm*—Kolisch Hartwell, et al.

(57) ABSTRACT

A doll with an angled and/or jointed torso. In some embodiments the doll includes a torso, at least a portion of which is asymmetric about a midline such that an angle formed between a left lateral contour and the midline substantially differs from an angle formed between a right lateral contour and the midline. Alternatively, or additionally, the torso may be comprised of an upper torso member that is connected to a lower torso member by a joint that enables rotation therebetween.

20 Claims, 5 Drawing Sheets

U.S. PATENT DOCUMENTS 3,921,332 A 11/1975 Terzian et al.
3,942,284 A 3/1976 Kublan
3,955,311 A 5/1976 Lyons et al.
3,988,855 A 11/1976 Crabtree et al.
4,006,555 A 2/1977 England et al.
4,030,240 A 6/1977 Port
4,067,138 A 1/1978 Cederholm et al.
4,135,327 A 1/1979 Sapkus et al.
4,268,991 A 5/1981 Cotey et al.
4,274,224 A 6/1981 Pugh et al.
4,439,909 A 4/1984 Borgen et al.
4,467,555 A 8/1984 Terzian et al.
4,526,553 A 7/1985 Guerrero
4,552,480 A 11/1985 McIntyre
4,571,209 A 2/1986 Manning et al.
4,578,045 A 3/1986 Mayer et al.
4,623,318 A 11/1986 Tsiknopoulos et al.
4,649,010 A 3/1987 Bennett et al.
4,662,224 A 5/1987 Turbe
4,662,857 A 5/1987 Quinn et al.
4,669,998 A 6/1987 Amici et al.
4,673,374 A 6/1987 Kelley
4,674,990 A 6/1987 Ohno
4,680,018 A 7/1987 Ohno
4,680,019 A 7/1987 Baerenwald et al.
4,723,932 A * 2/1988 Kelley et al. ..... 446/330
4,790,789 A 12/1988 Mathis
4,890,356 A 1/1990 Czech et al.
4,916,788 A 4/1990 Mitoya
4,952,189 A 8/1990 Barlow
4,968,280 A 11/1990 Kelley
5,257,873 A 11/1993 Abbat
5,676,484 A 10/1997 Chamberlin et al.
5,755,526 A 5/1998 Stanevich
5,897,417 A 4/1999 Grey
5,911,617 A * 6/1999 Chou ..... 446/353
5,989,658 A 11/1999 Miura
6,022,263 A * 2/2000 Liu et al. ..... 446/379
6,033,284 A 3/2000 Rodriguez
6,042,451 A 3/2000 Feldman
6,110,002 A 8/2000 Langton
6,126,508 A * 10/2000 Chou ..... 446/358
6,200,192 B1 * 3/2001 Hou ..... 446/358
6,287,166 B1 9/2001 Lee et al.
6,328,625 B1 12/2001 Lee et al.
6,422,916 B1 7/2002 Enku
6,435,936 B1 * 8/2002 Rehkemper et al. ..... 446/297
6,435,938 B1 8/2002 Lee et al.
6,482,068 B1 11/2002 Lee et al.
6,500,043 B1 * 12/2002 Fong ..... 446/330
6,776,681 B1 * 8/2004 Willett ..... 446/300
2002/0055322 A1 5/2002 Lee et al.
2002/0058458 A1 5/2002 Lee et al.
2002/0090880 A1 7/2002 Lee et al.
2002/0127949 A1 9/2002 Lee et al.

FOREIGN PATENT DOCUMENTS

EP 0256818 8/1987
JP 62-050112 3/1987
JP 62-128719 6/1987
JP 62-129076 6/1987
JP 62-155893 10/1987
JP 62-246392 10/1987

OTHER PUBLICATIONS

1987 Mattel Skipper Figure.
1994 Hasbro GI Joe Commemorative Edition Figure.
1996 Hasbro GI Joe Classic Collection Figure.
Bandai 1996 Kankichi Ryotso.
1996 Hobby Japan Magazine.
1997 Playmates Pro Zone toy figure.
2000 McFarlane Toys.
2002 Hasbro STIKFAS Action Figure.
2003 Sunco Playmind Body Rockers.

* cited by examiner

DOLL WITH ANGLED AND JOINTED TORSO

CROSS-REFERENCE TO RELATED APPLICATIONS

This application claims priority under 35 U.S.C. 119(e) to U.S. Provisional Patent Application No. 60/473,908 entitled "Doll With Torso Joint And Sound Activation," filed May 27, 2003, the disclosure of which is incorporated herein by reference.

BACKGROUND

The present disclosure relates generally to movable toys, and more specifically, to dolls and action figures. Examples of dolls with upper torso pivots are shown in U.S. Pat. Nos. 3,921,332, 4,968,282, and 6,422,916, the disclosures of which are incorporated herein by reference. Some of the prior art upper torso joints only allow for rotation about a single axis and thus have limited play options. Additionally, most toys do not adequately represent the variety of body types and personalities present in children and young adults. Moveable joints may provide a more lifelike appearance, particularly when such movements also trigger an audio response.

SUMMARY

The present disclosure is directed to movable toys, such as dolls or action figures, that have an asymmetric body or body portion. In some embodiments, the toy includes one or more torso members. Either torso member may be asymmetric about a midline that visually divides that torso member into a left half and a right half such that an angle formed between a left lateral contour and the midline substantially differs from an angle formed between a right lateral contour and the midline. In some embodiments the doll includes a joint disposed between an upper torso member and a lower torso member.

The advantages of the present disclosure will be understood more readily after a consideration of the drawings and the Detailed Description.

DETAILED DESCRIPTION AND BEST MODE OF THE DISCLOSURE

Many toys, namely dolls and actions figures, are typically produced in a single size and therefore do not accurately represent the variety of body types that youths possess. The prior art toys are also limited in their available play options and poses due to limitations in the range of motion offered by prior joint designs. There is therefore a need for greater variety in appearance and joint mobility. The present disclosure provides a group of toys with variety in both body type and movement to more closely reflect the physiques and personalities of youths.

Figure 1:
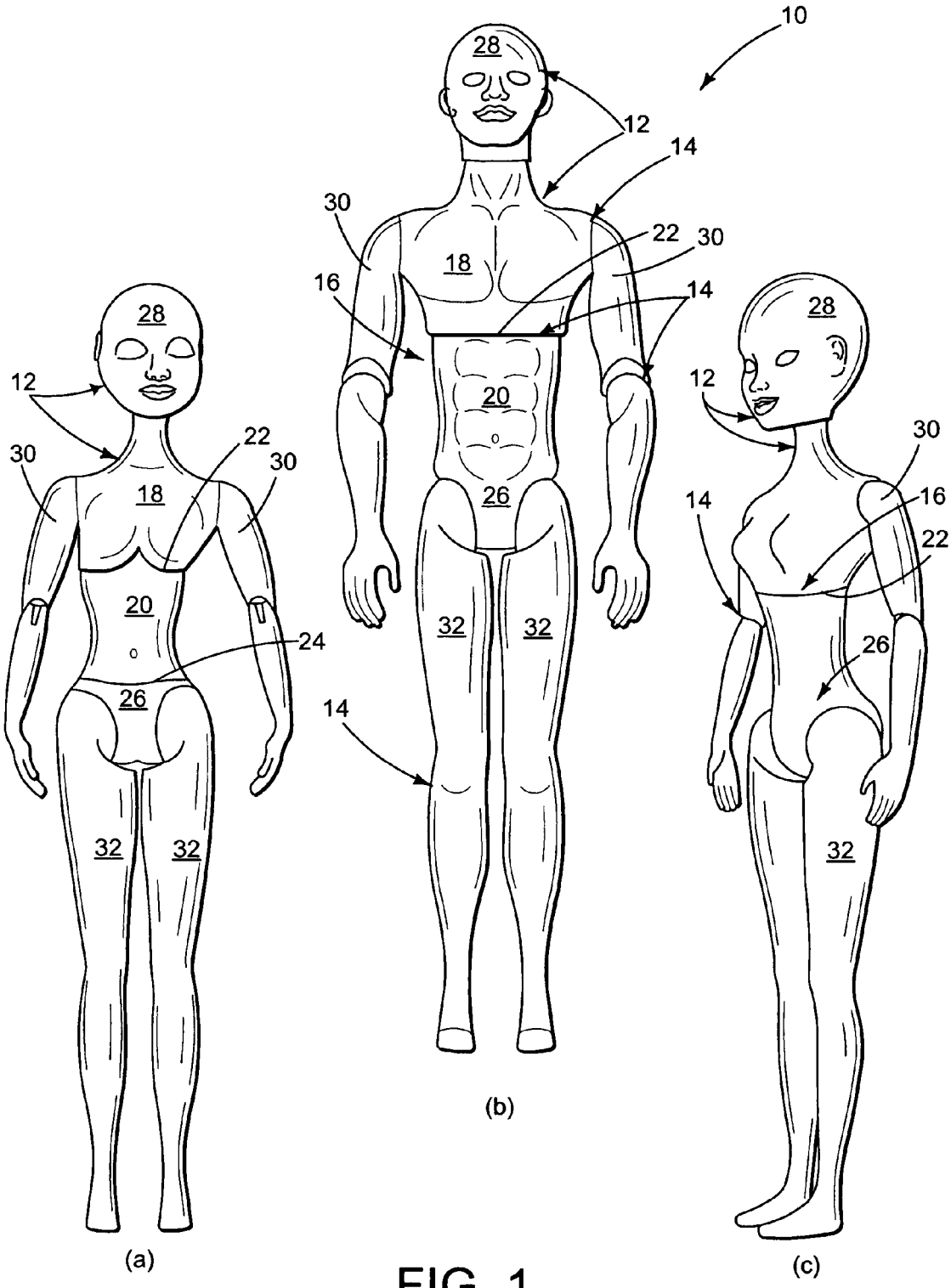
FIG. 1 depicts toys according to the present description. In (a) a doll is shown having an angled and V-shaped upper torso. In (b) an action figure is shown having an upper torso joint. In (c) a doll is shown having an angled upper torso and an upper torso joint.

FIG. 1 depicts toys 10 according to the present description. Each toy has a unique shape and combination of joints. In the depicted example, toys 10 are implemented as dolls or action figures having several body members 12 that may have movable interconnections therebetween. These movable interconnections take the form of joints 14 defined between body members 12. The joints enable the various body members to be moved relative to one another to achieve a variety of poses.

Typically, a given joint is configured to enable one part of the toy (e.g., a body member) to be moved relative to another, and then maintain the relative position of the parts once a desired position has been achieved. In the examples shown in FIG. 1, dolls 10 have a torso 16 that may include an upper torso member 18 and a lower torso member 20. Thus, one of joints 14 may form a torso joint 22, defined between the upper and lower torso members to enable relative motion therebetween. Doll 10 may also include a waist joint 24 that joins lower torso member 20 to a pelvis member 26. It should be appreciated that neither, one, or both of these joints may be incorporated into doll 10. Thus, in some embodiments torso 16 and pelvis member 26 may be integrally formed.

Dolls 10 may also include a head 28, arms 30, and legs 32. Although the remaining description will focus primarily on the torso joint and the overall shape of the torso, it should be appreciated that the joint structures and mechanisms to be discussed may be implemented in other locations on a doll (e.g. the neck, shoulders, elbows, waist, hips, and knees) and in movable toys other than dolls.

Figure 2:
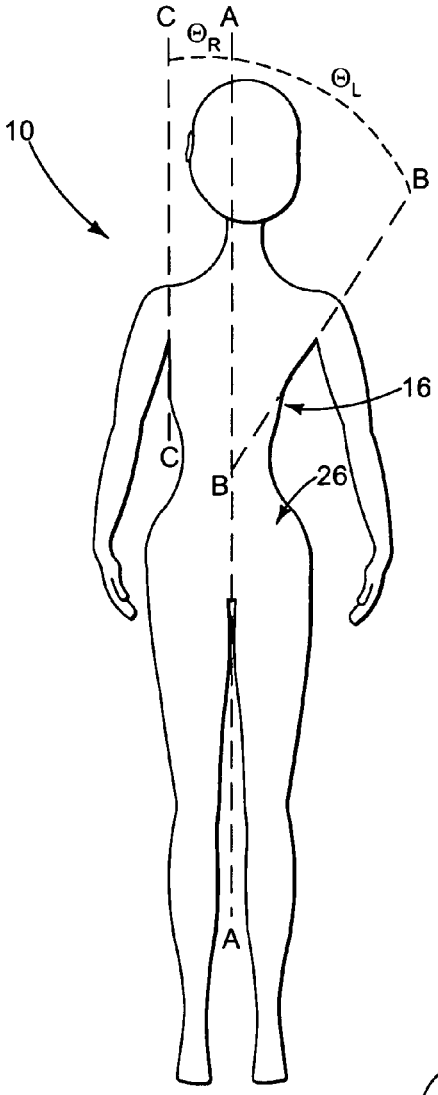
FIG. 2 illustrates differences between left and right lateral contours of the angled upper torso of a doll, similar to that shown in FIGS. 1(*a*) and 1(*c*), and their resulting angles with respect to a midline.
Figure 3:
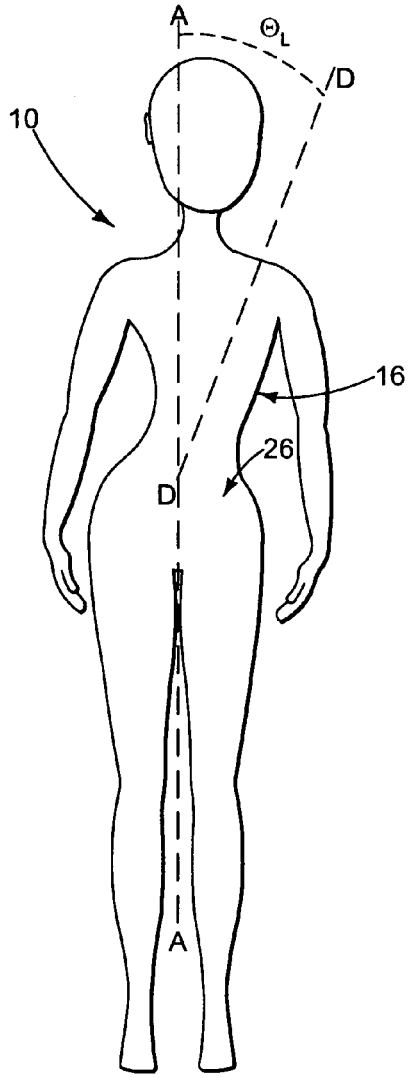
FIG. 3 illustrates differences between left and right lateral contours of an alternate embodiment of an asymmetric torso.

To impute doll 10 with additional personality or "attitude" even when doll 10 is in a neutral position with respect to joint mobility, either one or both of the torso members may be angled, or offset, as illustrated in FIGS. 2 and 3. As shown in FIG. 2, a midline A—A runs through the pelvis of doll 10 and visually divides the body into a left half and a right half. Each doll 10 therefore has a left lateral contour B—B and a right lateral contour C—C. In some embodiments, the torso member is asymmetric about midline A—A such that the angles formed between each lateral contour and the midline substantially differ from each other.

In the example shown in FIG. 2, the upper portion of torso 16 forms a greater left angle $\Theta_L$, between midline A—A and left contour B—B, than a right angle $\Theta_R$, between midline A—A and right lateral contour C—C, since in the embodiment shown midline A—A is parallel to contour C—C. This asymmetry may be embodied in upper torso member 18, as previously shown in FIG. 1(*c*). It should be appreciated that any portion of torso 16 may be contoured to achieve this asymmetrical effect and the invention is not limited to that depicted. For example, the above-described asymmetry may occur in the lower portion of torso 16, such as in lower torso member 20, as shown in FIG. 3. There, a lower torso midline D—D is drawn relative to pelvis midline A—A to show that at least a portion of the torso is contoured so that lower torso midline D—D is nonparallel to pelvis midline A—A. The lateral contours of lower torso member 20 are angled to laterally offset upper torso member 18 from pelvis member 26.

Figure 4:
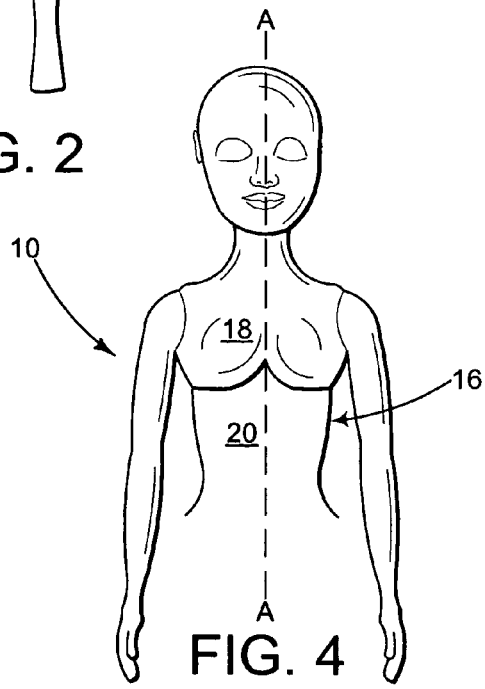
FIG. 4 illustrates a symmetrically V-shaped upper torso.

Upper torso member 18 may include additional contours that either add to the personality of the doll or assist in smooth movement of the doll components relative to one another. In some embodiments upper torso member 18 forms a V-shape that is centered along midline A—A when the upper and lower torso members are in neutral positions, as shown in FIG. 4. Such a configuration may enable the upper torso of the doll to more smoothly glide over the lower torso of the doll, as will subsequently be discussed, or may assist in providing greater anatomical accuracy.

Figure 5:
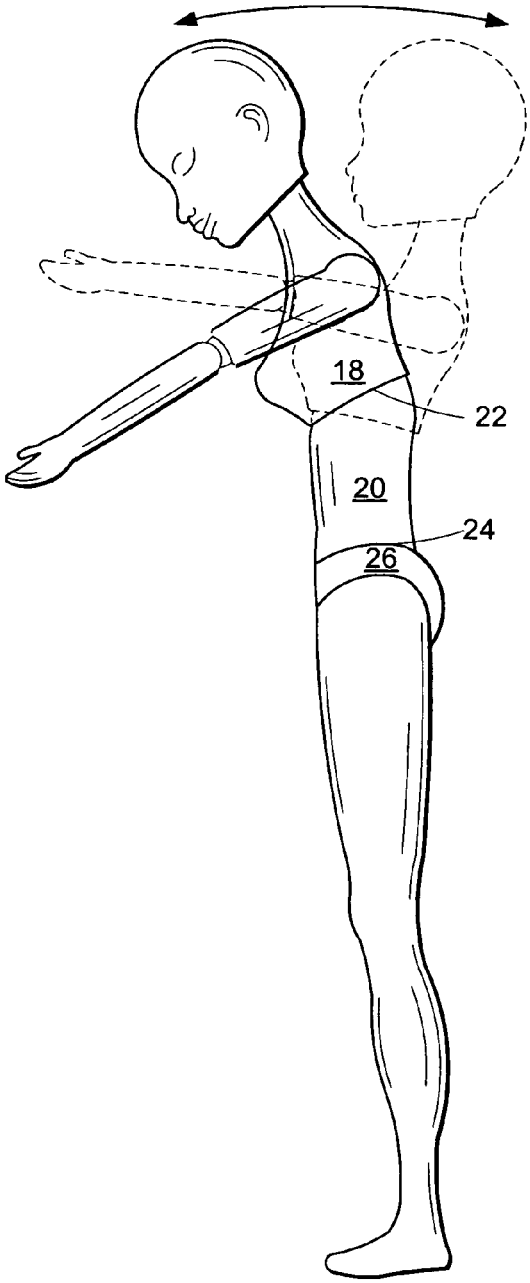
FIG. 5 illustrates front-to-back movement of the upper torso joint shown in FIG. 1(*c*).
Figure 6:
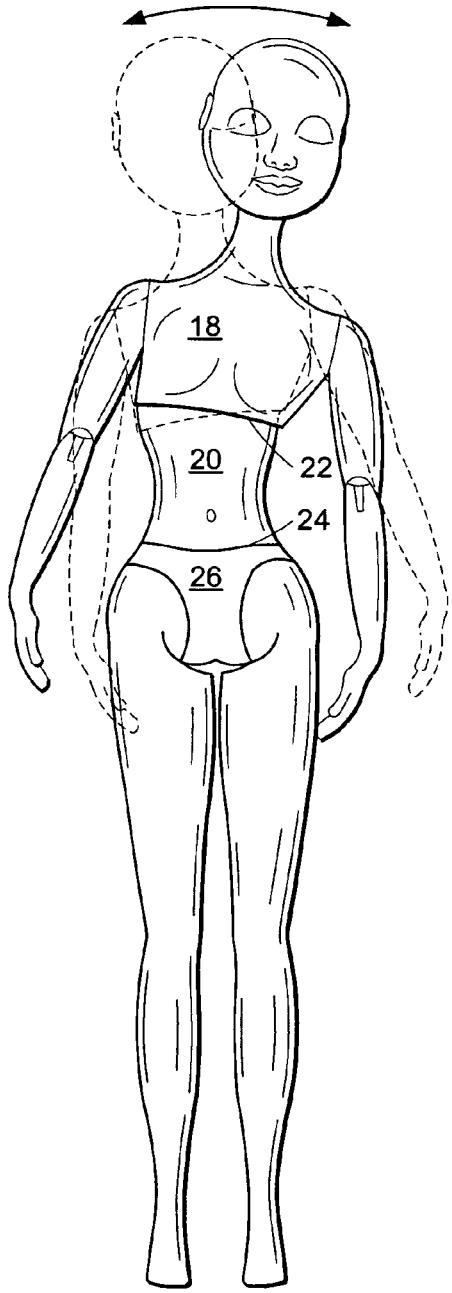
FIG. 6 illustrates side-to-side movement of the upper torso joint shown in FIG. 1(*c*).

The above-described asymmetries and contours of doll 10 allow the doll to portray a distinctive attitude even when the body members are in a neutral position, as shown previously in FIG. 1(*a*). The addition of torso joint 22 provides more play options and attitude, thus giving the doll an intense personality. As shown in FIGS. 5 and 6, torso joint 22 enables doll 10 to move in a plurality of directions, including but not limited to side-to-side movement and front-to-back movement. It should be appreciated that the range of movement is dependent upon the internal joint mechanisms, as will be subsequently discussed.

Figure 7:
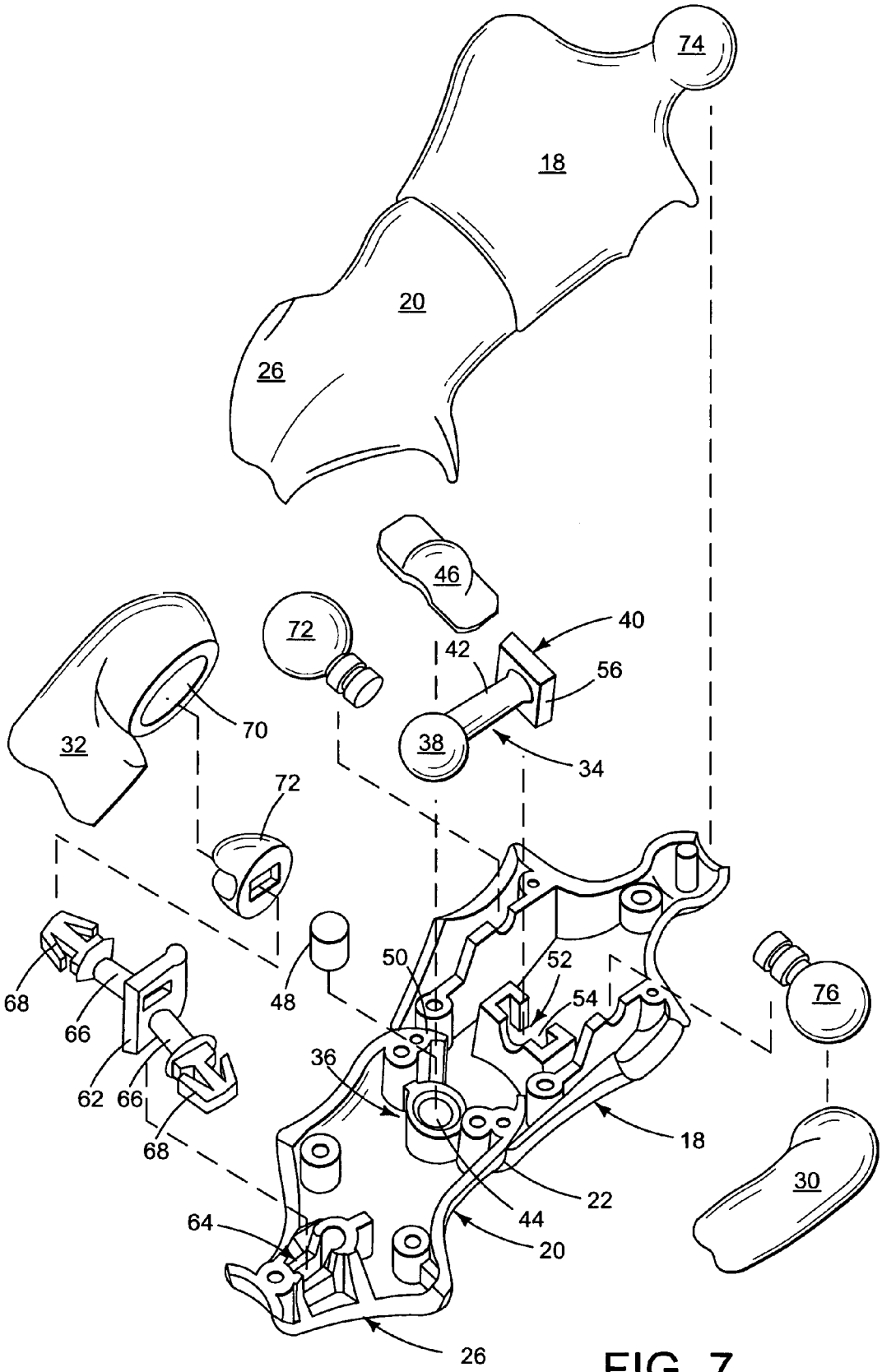
FIG. 7 depicts an exploded view of the doll of FIG. 1(*c*), showing components of the upper torso joint, according to the present description.
Figure 8:
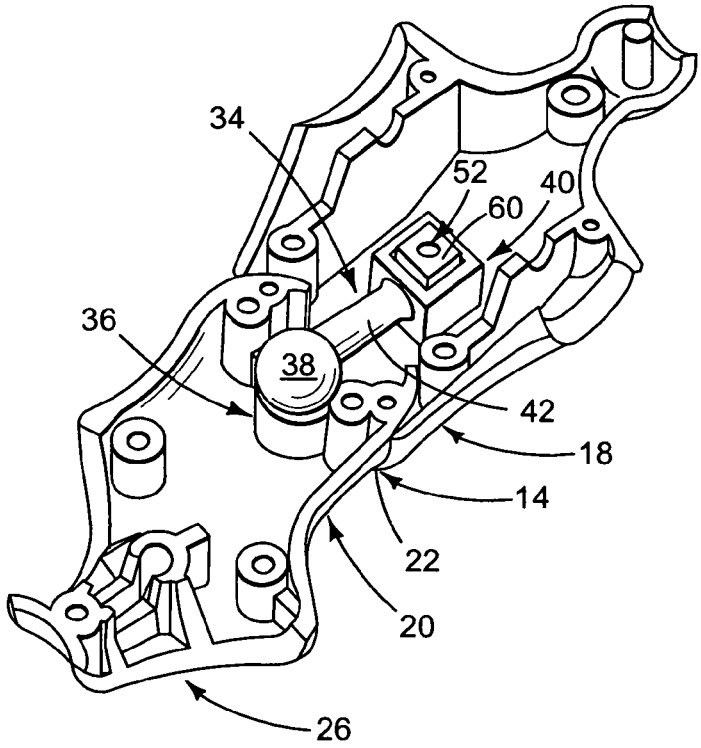
FIG. 8 illustrates an alternate embodiment of the components of the upper torso joint of FIG. 7.

Moving on to FIGS. 7 and 8, torso joint 22 includes a plug portion 34 and a socket portion 36 that receives the plug portion. Plug portion 34 has an operative region 38 and an anchor region 40, which are spaced apart at opposing ends of the plug portion and connected together by a shaft 42. In some embodiments, socket portion 36 is formed in the lower of the body members, such as lower torso member 20, while anchor region 40 of plug portion 34 is secured to upper torso member 18, as shown in FIGS. 7 and 8, although this configuration could be reversed. Thus, operative region 38 is adapted to mate with socket portion 36 while anchor region 40 is adapted to mate with the other of the upper and lower torso members.

The embodiments shown in FIGS. 7 and 8 depict the body members 12 as being comprised of front and back portions. It should be appreciated that such a configuration may be desirable for ease of manufacturing and is not intended to affect the subsequently described arrangement of internal components. Although the components are depicted as engaging with the front portion of upper torso member 18 and lower torso member 20, the components may alternatively be coupled to the back or any other portion of these members. In the arrangement shown, a plurality of pin joints are used to mate the front and back portions together.

In the illustrative examples of FIGS. 7 and 8, socket portion 36 has a seat 44 that receives operative region 38. A plate 46 may then be placed over the remainder of operative region 38 so that seat 44 and plate 46 straddle and press against operative region 38, thereby restricting translation of the plug portion relative to socket portion 36. As shown, operative region 38 is convex while seat 44 is concave. Seat 44 may be adapted to center operative region 38 thereupon and provide significant contact between the respective surfaces to reduce relative motion through friction.

Seat 44 typically includes a friction pad 48. Operative region 38 may be pressed against friction pad 48 to increase the friction between operative region 38 and seat 44 and thereby further limit motion within the joint.

Plate 46 may be used to secure plug portion 34 in place throughout the remainder of production of doll 10. For example, plate 46 may be sonically welded to seat 44, or fastened by other means such as screws or pins. Alternatively, plate 46 is integral with its respective torso member and the front and back portions of the body member are joined using the previously described pin joints to secure plug portion 34 in between the front and back portions of lower torso member 20.

Lower torso member 20 typically has a domed region, such as arcuate edge 50, to facilitate smooth multi-directional movement relative to upper torso member 18. Because socket portion 36 is enclosed by lower torso member 20, operative region 38 is concealed by lower torso member 20. Arcuate edge 50 forms an aperture through which shaft 42 passes to allow plug portion 34 to extend between the upper and lower torso members.

In the illustrative example shown in FIG. 7, upper torso member 18 has a receiving region 52 that receives anchor region 40 to couple and secure plug portion 34 to upper torso member 18. As shown, receiving region 52 forms a pocket 54 to receive anchor region 40. Anchor region 40 extends laterally away from shaft 42 to form an endplate 56. Endplate 56 may be of the same dimensions as receiving region 52 so that endplate 56 is retained within receiving region 52 once it is laterally inserted into the receiving region in a direction parallel to endplate 56. To maintain a secure fit, pocket 54 may have dimensions substantially similar to that of endplate 56.

In an alternate embodiment, such as that depicted in FIG. 8, anchor region 40 forms a ring 58 that may be mated with receiving region 52 in the form of a post 60. In the example shown in FIG. 8, ring 58 is a polygon, with a cross-section such as that of a square having chamfered corners, which surrounds post 60. Alternatively, ring 58 and/or post 58 may have sharp corners or be of any other suitably matching geometries.

The previously discussed body members may further include appendages or be adapted to receive other body members via additional joints 14. As shown in FIG. 7, legs 32 may be attached to pelvis 26 by placing post 62 into slot 64. Crossbar 66 extends away from pelvis member 26 and connects post 62 to expandable extensions 68. Legs 32 may be attached to extensions 68 by pressing each extension into a spherical insert 72 that mates with aperture 70. Alternatively, legs 32 may be coupled to pelvis member 26 using a design similar to that of the previously described upper torso joint 22. The neck and shoulders may be ball and socket joints, as shown for ball portions 74 and 76.

Figure 9:
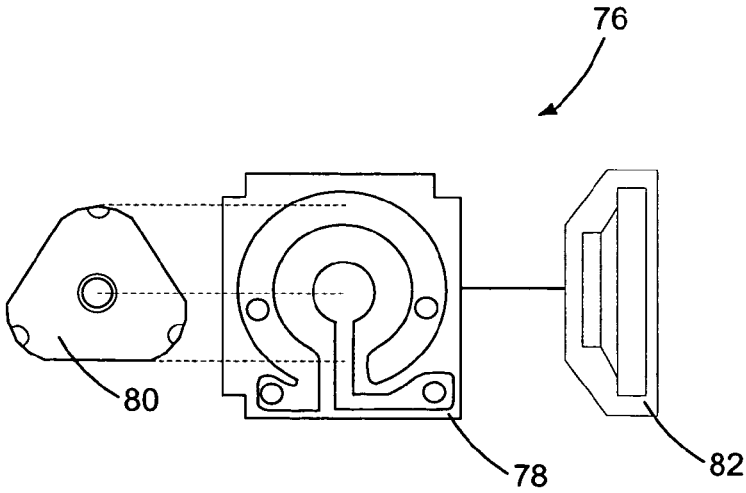
FIG. 9 illustrates a speech assembly adapted to be placed in the upper torso joint of FIGS. 7 and 8 to activate speech when the upper torso joint is articulated.

Doll 10 may include speech capability, such as a twist-and-talk feature. As shown in FIG. 9, a speech assembly 76 including a printed circuit board or memory chip 78 and an activation dome switch 80 may be located within a joint, such as upper torso joint 22. The speech assembly may be activated to produce sound by relative movement between body members 12 such as when twisted, tilted, or bent relative to one another so that a dome switch is activated. For example, a memory chip, located in the lower torso of the doll, may be activated by a dome switch, located in the dolls' upper torso joint, when the upper torso is moved to position the doll in a different pose. Random speech may be selected from several available phrases and emitted from a speaker 82 that typically faces the front of the doll. Doll 10 may include an on/off switch to the sound activation mechanism. Further, batteries are included to provide power to the speech assembly.

Each doll may also include interchangeable clothing and accessories, style-able hair, and unique head and body sculpts to further add to the uniqueness of each doll's appearance and personality. For example the dolls may represent either gender, a variety of ethnic backgrounds, and a variety of body types that differ from one another in stature and weight. The accessories may include: a school uniform, sporting attire, street clothes, a hairbrush, hairclips, socks, shoes, sporting good items, sunglasses, a cell phone, a laptop computer, a CD, a handbag, and the like. These accessories may also be used to trigger the speech assembly as is known in the art.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

We claim:

1. A doll comprising:

an upper torso member having an upper torso midline; and a lower torso member having a lower torso midline, wherein:

the upper torso member is connected to the lower torso member by a joint that enables rotation therebetween; and at least one of the torso members is asymmetric about the corresponding upper torso midline or lower torso midline such that an angle formed between a left lateral contour and the corresponding torso midline substantially differs from an angle formed between a right lateral contour and the corresponding torso midline.

2. The doll of claim 1, wherein the joint comprises:

a plug portion having an anchor region and an operative region located at opposing ends of the plug portion and connected to each other by a shaft; and a socket portion adapted to receive the operative region of the plug portion and having a seat and a plate that straddle and press against the operative region of the plug portion, thereby restricting translation of the plug portion.

3. The doll of claim 2, wherein the seat and the plate are adapted to be sonically welded together, thereby securing the operative region of the plug portion within the socket portion.

4. The doll of claim 2, wherein the seat includes a friction pad adapted to be placed between the seat and the operative region of the plug portion to increase friction therebetween.

5. The doll of claim 2, wherein the anchor region of the plug portion couples the plug portion to the upper torso member via engagement between the anchor region and a receiving region within the upper torso member, the anchor region extending laterally away from the shaft to form an endplate.

6. The doll of claim 5, wherein the receiving region forms a pocket to receive the anchor region when the anchor region is inserted into the receiving region in a direction parallel to a plane formed by the endplate.

7. The doll of claim 1, wherein an edge of the upper torso member forms a V-shape that is centered along the upper torso midline.

8. The doll of claim 1, further comprising a speech assembly adapted to produce sound and activated by relative movement between the upper torso member and the lower torso member.

9. The doll of claim 8, wherein the speech assembly includes a dome switch.

10. A doll comprising:

a pelvis member having a pelvis midline;

a lower torso member having a lower torso midline;

an upper torso member, wherein at least a portion of the lower torso member is contoured so that the lower torso midline is nonparallel to the pelvis midline, and the upper torso member is laterally offset from the pelvis member; and a joint disposed between the upper torso member and the lower torso member, wherein the joint includes;

a socket portion mounted within one of the upper and lower torso members; and a plug portion having an operative region adapted to mate with the socket portion and an anchor region adapted to mate with the other of the upper and lower torso members, wherein the anchor region forms an endplate configured to couple with a receiving region of the respective torso member.

11. The doll of claim 10, wherein the receiving region forms a pocket having dimensions substantially similar to that of the endplate.

12. The doll of claim 10, wherein an edge of the upper torso member forms a V-shape that is centered over the lower torso midline when the upper torso member and the lower torso member are in neutral positions.

13. The doll of claim 10, further comprising a speech assembly adapted to produce sound and activated by relative movement between the upper torso member and the lower torso member.

14. A movable toy with a plurality of body members comprising:

a first body member;

a second body member;

a joint coupling the first and second body members such that the first body member is rotatable relative to the second body member in a plurality of directions, and the joint is defined by a socket portion formed within the first body member and a plug portion having an operative region and an anchor region, wherein the operative region engages with the socket portion and the anchor region couples the plug portion to the second body member; and a third body member adapted to represent a pelvis and divided into left and right halves by a pelvis midline, at least a portion of one of the first and second body members is asymmetric about the pelvis midline when the body members are in a neutral position relative to one another.

15. The movable toy of claim 14, wherein a plate extends from the anchor region and is adapted to mount within a pocket of corresponding geometry located in the second body member.

16. The movable toy of claim 15, wherein the socket portion includes a seat and a plate that straddle the operative region of the plug portion and press against the operative region, thereby restricting translation of the plug portion relative to the socket portion.

17. The movable toy of claim 14, wherein the first body member is an upper torso member and the second body member is a lower torso member.

18. The movable toy of claim 17, wherein the body further includes a pelvis member and the lower torso member is angled and thereby adapted to laterally offset the upper torso member relative to the pelvis member.

19. The movable toy of claim 17, wherein the upper torso member is asymmetric about the midline of the body so that an angle formed between a left lateral contour and the midline substantially differs from an angle formed between a right lateral contour and the midline.

20. A doll comprising:

an upper torso member; and a lower torso member, wherein:

the upper torso member is connected to the lower torso member by a joint that enables rotation there between; and wherein the joint includes a plug portion having an anchor region and an operative region located at opposing ends of the plug portion and connected to each other by a shaft; and a socket portion adapted to receive the operative region of the plug portion and having a seat and a plate that straddle and press against the operative region of the plug portion, thereby restricting translation of the plug portion; and at least one of the torso members is asymmetric about a midline that visually divides that torso member into a left half and a right half such that an angle formed between a left lateral contour and the midline substantially differs from an angle formed between a right lateral contour and the midline.

* * * * *